United States Patent [19]

Capson

[11] Patent Number: 4,858,935

[45] Date of Patent: Aug. 22, 1989

[54] HUNTING ARROW WITH SIGNAL GENERATING MEANS

[75] Inventor: Ronnie R. Capson, Blackfoot, Id.

[73] Assignee: Michael D. Ferguson, Rexburg, Id.

[21] Appl. No.: 205,478

[22] Filed: Jun. 13, 1988

[51] Int. Cl.[4] ..... F41B 5/02

[52] U.S. Cl. ..... 273/416

[58] Field of Search ..... 273/416, 418, 419–422; 455/96, 98, 100, 66; 604/59–64; 128/330, 903; 43/6

[56] References Cited

U.S. PATENT DOCUMENTS

| | | | |
|---|---|---|---|
| 2,519,553 | 8/1950 | Faulkner | 455/96 |
| 2,907,327 | 10/1959 | White | 604/60 |
| 3,790,948 | 2/1974 | Ratkovich | 343/113 |
| 3,893,866 | 7/1975 | Hollingsworth | 273/418 |
| 4,421,319 | 12/1983 | Murphy | 273/416 |
| 4,597,580 | 7/1986 | Gassie | 273/418 |
| 4,651,999 | 3/1987 | Sturm | 273/416 |
| 4,675,683 | 6/1987 | Robinson et al. | 342/386 |
| 4,700,692 | 10/1987 | Baumgartner | 604/63 X |
| 4,704,612 | 11/1987 | Boy et al. | 342/386 |
| 4,749,198 | 6/1988 | Brailean | 273/416 |

*Primary Examiner*—Paul E. Shapiro

*Attorney, Agent, or Firm*—Hopkins French Crockett Springer & Hoopes

[57] ABSTRACT

A hunting arrow especially adapted to eject a transmitter into a quarry animal to enable location of the quarry after having been shot. The device is particularly useful in the event that the hunting arrow passes completely through the quarry, or if imbedded therein is broken off or pulled out by the quarry. The hunting arrow comprises an apparatus for retaining the transmitter within the arrow, which when moved rearwardly along the shaft of the arrow, permits a spring-loaded transmitter to be ejected into the body cavity of the quarry.

11 Claims, 3 Drawing Sheets

HUNTING ARROW WITH SIGNAL GENERATING MEANS

BACKGROUND OF THE INVENTION

The present invention relates to a hunting arrow, and more specifically to a hunting arrow having signal generating means, in the form of a transmitter, located therein to enable a bow hunter to locate the arrow after a missed shot, or the wounded animal after a successful shot.

The bow hunting of big game animals is increasing in popularity in the United States. White-tailed deer, mule deer, elk, antelope and bear are only a few of the species currently being hunted. State-of-the-art hunting arrows typically have a hollow fiber-glass or aluminum shaft and are provided with a removable and interchangeable tip, or "broadhead". The type, size, weight, etc., of a broadhead may be changed depending upon the animal hunted, the weather conditions, the terrain, etc. Such arrows are quite expensive, typically ranging in price from $5.00 to $7.00.

Two distinct problems are common with bow hunters: (1) locating the arrow resulting from a missed shot and (2) locating the injured animal (if an immediate kill is not made) resulting from a successful shot. Even the best of hunters miss their target about 20–25% of the time, and less experienced hunters even more. When shooting from a range of 50–200 yards, it is not uncommon to lose the arrows resulting from errant shots. A typical hunter may lose 10–20 arrows per year, resulting in a substantial financial loss. Even more importantly, however, the loss of game resulting from successful shots is significant. While it is possible to drop a smaller animal immediately with a well-placed shot, larger animals such as deer, elk, bear, etc., are seldom instantly killed by an arrow. Whether the arrow passes completely through the animal or remains imbedded therein, the animal may run for from a few hundred yards to two miles before either dying or resting.

Hunting arrows have been developed which contain transmitters, enabling the bow hunter with a receiving unit to locate either the arrow after an errant shot, or the quarry after a successful shot, presuming the arrow remains imbedded in the quarry. For instance, U.S. Pat. No. 3,790,948 discloses a battery-powered transmitter located within the broadhead and having a rigid antenna extending through the shaft of the arrow. The arrow of U.S. Pat. No. 4,421,319 includes a transmitting device located in the nock of the arrow. The device may also include an audible signal generator to further aid location of the arrow. U.S. Pat. No. 4,675,683 discloses a transmitter positioned intermediate the arrowhead and the nock of a hunting arrow. The transmitter is provided as an extension of the arrow between the main body of the arrow and the arrowhead. The shaft of the arrow serves as the antenna for the transmitter and the transmitter remains with the arrow at all times.

The foregoing patents have addressed the problem of errant shots and successful shots wherein the arrow remains imbedded in the quarry, but in a significant number of cases of successful shots in relatively smaller animals (such as whitetail deer) the arrow passes completely through the animal, severely injuring but not necessarily immediately incapacitating it. If imbedded, the arrow is usually broken off against trees, rocks, etc., or pulled out by the injured animal. In such cases the animal may run a substantial distance before dying, making it quite difficult to find, even if one of the arrows of the prior art is utilized.

SUMMARY OF THE INVENTION

Accordingly, the present invention provides a means for emplacing a signal generating device (or transmitter) within the quarry so that in the event the arrow passes completely through the quarry, or is pulled out or broken off, the transmitter will remain with the injured animal, enabling it to be located by a corresponding receiver.

Therefore, the arrow of the present invention, in its broadest embodiment, is provided with a releasable signal generating means which is released from the arrow inside the target animal when hit by the inventive arrow. While a number of different embodiments may be utilized, it is contemplated that a preferred embodiment will comprise an extension onto the forward end of a conventional hunting arrow. The extension will be provided with a chamber within which the transmitter is emplaced. The transmitter is provided with an elongate, flexible antenna which is disposed either within the arrow shaft or within the chamber. The arrow is provided with means to releasably retain the transmitter within the chamber, which permits its ejection within the quarry. Finally, means to eject the transmitter from the chamber are provided.

In a preferred embodiment, the chamber is provided as a "window" in the arrow shaft, or an extension to the shaft, the chamber being provided with an end wall at the forward-most end of the chamber and an outwardly sloping end wall at the rearward end of the chamber. Alternatively, the sloping end wall may be located at the forward end of the chamber to permit a forward, rather than rearward, ejection of the transmitter. The transmitter may be spring-loaded within the chamber, and retained therein by a moveable sleeve positioned over the chamber, which slides longitudinally along the arrow shaft. Upon striking the quarry, the broadhead enters the animal the sleeve is preferentially retained either by the hide of the animal or some internal organ, and slides rearwardly along the arrow shaft; FIG. 5 is a section viewing showing the transmitter of the present invention incorporated into an extension fitted between a conventional arrow shaft and arrow head. After sliding rearwardly a sufficient distance to expose the chamber, the transmitter is "ejected" into the body cavity of the quarry by the spring bearing against the forward-most end wall. As the arrow travels through the animal, the antenna is withdrawn from the arrow. After passing completely through the animal, the antenna may protrude from the exit wound of the quarry. In any event, the transmitter is imbedded within the quarry and can be easily tracked with an appropriate receiving unit.

The transmitter may be actuated manually prior to making the shot, automatically actuated upon release of the arrow from the drawn bow string or upon impact with the quarry. Preferably, the transmitter generates a pulsating signal which may be received at distances of at least two miles.

DETAILED DESCRIPTION OF THE INVENTION

Figure 1:
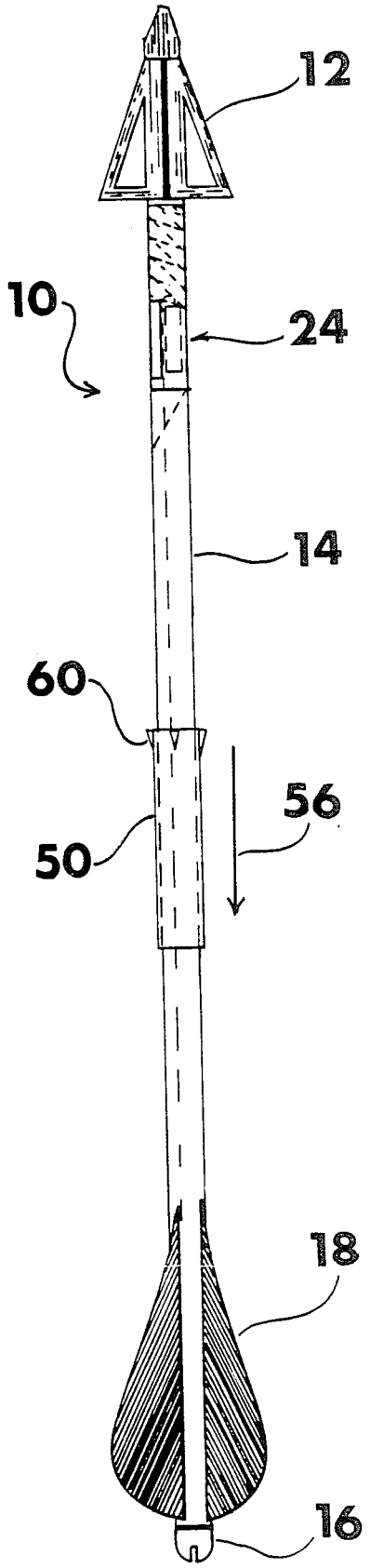
FIG. 1 is a plan view, in partial sectional view, hunting arrow of the present invention.
Figure 2:
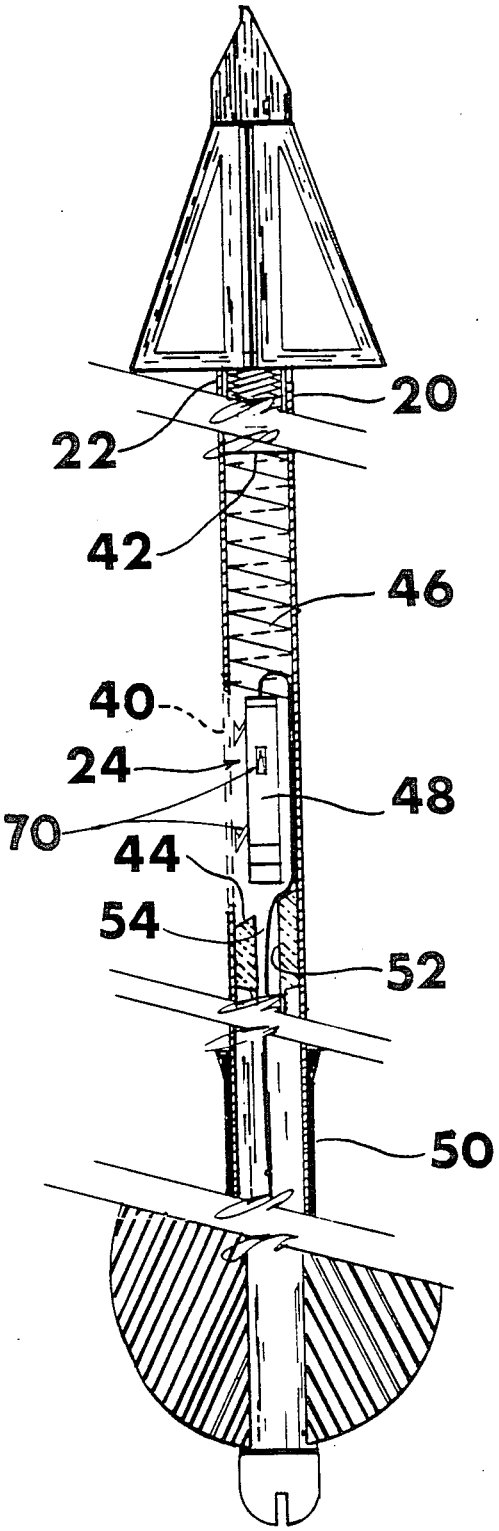
FIG. 2 is an enlarged partial sectional view of a hunting arrow of the present invention.

FIG. 1 illustrates a hunting arrow generally designated 10, having a broadhead 12, shaft 14, nock 16, and fletchings 18. As illustrated in FIG. 2, the broadhead 12 is removably affixed to shaft 14 to permit the interchange of various broadheads depending upon the particular conditions. For instance, the broadhead may be affixed as by screwing the broadhead with threaded male member 20 into threaded female plug 22 affixed in the forward-most end of shaft 14. The transmitter of the present invention, designated 24, may advantageously be interposed as an extension between broadhead 12 and shaft 14. The extension of the present invention may be threaded in the same manner as shown at 20, 22 of FIG. 2.

As shown more specifically in FIG. 2, hollow shaft 14 of arrow 10 may be provided with a signal generating means of the present invention. A "window" 40 may be provided within the shaft 14 rearward of plug 22. The window may simply be milled into the shaft of a conventional arrow. A forward wall 42, in the form of a plug, is placed forward of window 40. A rearward wall 44 is emplaced beneath a rearward portion of window 40. Spring member 46 biases the signal generating means (transmitter) 48 against sleeve 50 (shown in the "retracted" position in both FIGS. 1 and 2). An aperture 52 in rearward wall 44 permits antenna 54 to be disposed throughout the length of arrow shaft 14.

In a preferred embodiment, the spring member 46 biases transmitter 48 against the sloped wall 44 and against sleeve 50. While antenna 54 may be coiled within the window 40, the antenna may also be disposed throughout the length of the arrow through aperture 52. The plug 42 may be either glued in place or may be sized to maintain its position by friction. The plug 44 may likewise be glued or frictionally engaged within the window 40.

While the invention has been described above to eject the transmitter in a rearward direction, it should be appreciated that the location of walls 42, 44 can be reversed so that the transmitter is ejected forwardly rather than rearwardly.

Figure 3:
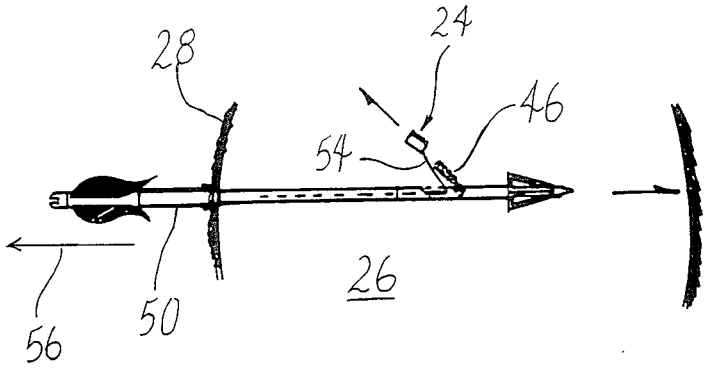
FIG. 3 is pictorial view of a hunting arrow of the present invention entering a target animal.
Figure 4:
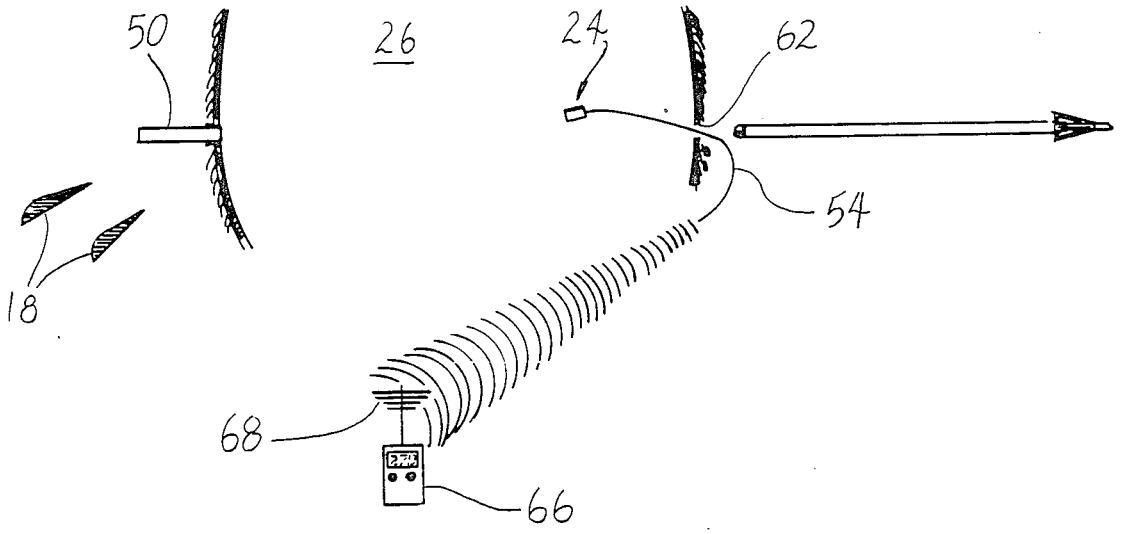
FIG. 4 is a pictorial view of a transmitter and receiver of the present invention.

The operation of the preferred embodiment illustrated herein is as follows: As the arrow enters the target animal 26 (FIG. 3), sleeve member 50, protruding somewhat from the smooth surface of arrow shaft 14 and slidably engaged therewith, is retained somewhat either by the hide 28 of the animal or viscera, bones, etc. In any event, the sleeve 50 is moved rearwardly along shaft 14 in the direction of arrow 56. As sleeve 50 moves rearwardly, the transmitter is "ejected" from the interior of shaft 14 by spring member 46 and into the body cavity of the target animal. In order to facilitate the opening of window 40, barbs or hooks 60 may be provided on sleeve 50 to insure its emplacement with the quarry and relative non-movement with 1 respect to arrow 10. Likewise, barbs or hooks 70 may be provided on the transmitter 48 so that it "catches" internally within the quarry to insure proper retention therein. As the arrow continues its movement through the quarry, antenna 54 is pulled from the arrow, and may protrude through the exit wound 62 in the quarry.

Figure 5:
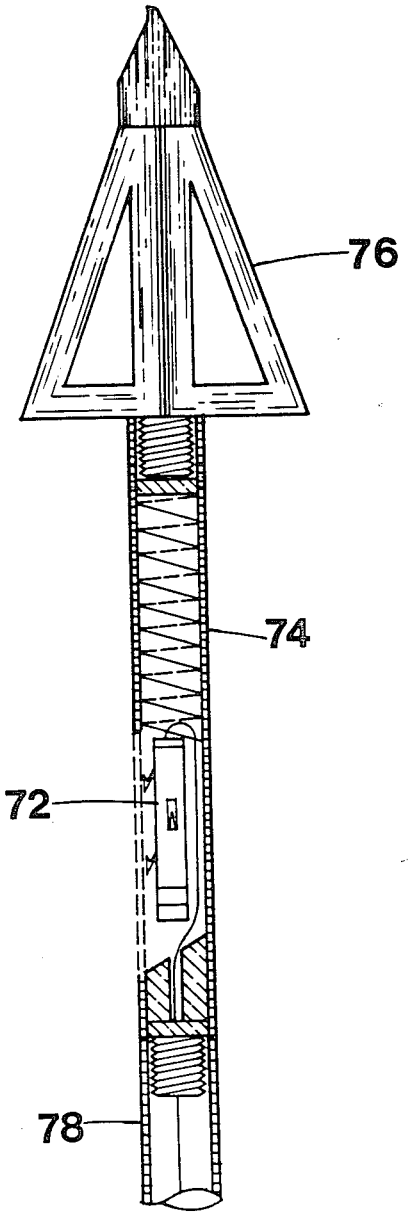

An alternative embodiment illustrated in FIG. 5 of the present invention is to provide the transmitter 72 in an extension 74 which may be interposed between a conventional broadhead 76 and arrow shaft 78. In such embodiment, a consumer need not purchase an entire arrow but rather only the extension containing the transmitter and ejection means. The method of disposing the antenna throughout the length of the arrow, as shown in FIGS. 1 and 2 could be employed in this embodiment. Alternatively, the antenna could be coiled within the window of the extension.

While the invention has been disclosed in a preferred embodiment in FIGS. 1–4, it is to be understood that the embodiment disclosed therein is not the sole means of deploying the transmitter within the target animal. For instance, the transmitter could be employed in the broadhead, which could be configured to break away from the arrow shaft upon impact, permitting the shaft to pass through the quarry while the broadhead remains therein. It is to be appreciated that in its broadest embodiment, the present invention is not limited to any specific means of placing the transmitter within the quarry, but encompasses any method whereby an arrow-borne transmitter is carried to and left within the target animal.

The transmitter is preferably battery operated and may be actuated either manually at any point prior to shooting the arrow or may be actuated by compression-type switches upon releasing the arrow from the bow or upon impact with the target animal. It would appear that, if cost is no factor, a compression-type switch activated upon releasing the arrow from a drawn bow is preferable since the battery life is conserved until the arrow is actually fired, and the transmitter will be actuated even without sudden impact with the quarry, tree, ground, etc. Alternatively, a compression-type switch which is activated upon impact with the quarry, ground, etc., may be utilized. Likewise, while the figures have illustrated the ejection means in the form of a coiled spring, any means to forcibly and rapidly eject the transmitter from the arrow will suffice, such as leaf springs, etc.

The transmitter should produce a signal which may be received at distances of up to about two miles. The transmitter may be preset with a code which can be entered into the receiver to insure picking up only the desired signal, as is commonplace in, for instance, garage door openers.

The antenna may be constructed of any suitably flexible metallic substance capable of functioning as an antenna.

The bow hunter will preferably be provided with a direction-finding receiver 66 having a directional antenna 68. The receiver is tuned to the appropriate preset frequency of the transmitter so that the direction and distance from the transmitter may be calculated and displayed.

While a preferred embodiment of the invention has been disclosed, various modes of carrying out the principles disclosed herein are contemplated as being within the scope of the following claims. Therefore, it is understood that the scope of the invention is not to be limited except as otherwise set forth in the claims.

I claim:

1. A hunting arrow having signal generating means therein and means to eject the signal generating means from the hunting arrow within an animal struck by said arrow.

2. The arrow of claim 1, wherein the signal generating means is located within a hollow shaft of said arrow, with a flexible antenna disposed through the shaft of said arrow.

3. A hunting arrow having a hollow shaft and an arrowhead, said arrow comprising:

a. a transmitter having an elongate antenna disposed within said arrow;

b. a chamber in the arrow to hold the transmitter;

c. means to retain the transmitter within the chamber; and d. means to eject the transmitter from the chamber when the means to retain the transmitter within the chamber is moved by contact with an animal to expose the chamber.

4. The arrow of claim 3, wherein said chamber is provided in an extension added to a conventional hunting arrow.

5. A hunting arrow having an arrowhead, a hollow shaft and a nock, said arrow comprising:

a. a chamber containing a signal generating means therein;

b. said chamber having a rigid forward wall and an outwardly sloping rearward wall;

c. said signal generating means being spring loaded within said chamber and bearing against the rigid forward wall;

d. a retaining member slidably affixed to the shaft to retain the signal generating means within the chamber; and e. the signal generating means having a plurality of gripping means thereon.

6. The arrow of claim 5, wherein the signal generating means is located within a hollow shaft of said arrow, with a flexible antenna disposed through the shaft of said arrow.

7. The arrow of claim 5, wherein said chamber is provided in an extension added to a conventional hunting arrow.

8. A hunting arrow having a hollow shaft with an exit port therein and a signal generating means spring-loaded within the hollow shaft, wherein the signal generating means is released from the hollow shaft through the exit port to the interior of an animal struck by the arrow.

9. The arrow of claim 8, wherein a sleeve member slidably retained on said shaft maintains the signal generating means within said shaft, such that when the arrow enters an animal the sleeve is moved in a rearward direction exposing the exit port and permitting the signal generating means to be released therefrom.

10. The arrow of claim 9, wherein said signal generating means and said sleeve member are provided with means to grip animal flesh and hide to prevent movement within the animal.

11. A hunting arrow having a hollow shaft with an exit port therein and a signal generating means retained within the hollow shaft, and means to cause the signal generating means to be is released from the hollow shaft through the exit port when an animal is struck by the arrow.

* * * * *